United States Patent [19]

Lezgintsev et al.

[11] 4,142,818

[45] Mar. 6, 1979

[54] DEVICE FOR TRAVELLING ALONG THE BASIN AND SEA BOTTOM

[76] Inventors: Georgy M. Lezgintsev, Leninsky prospekt, 39, kv. 257; Stanislav J. Istoshin, ulitsa Koptevskaya, 26, korpus 3, kv. 69; Mikhail A. Belyavsky, ulitsa Butlerova, 10, kv. 81, all of Moscow, U.S.S.R.

[21] Appl. No.: 777,412

[22] Filed: Mar. 14, 1977

[51] Int. Cl.[2] ..... B63C 11/00

[52] U.S. Cl. ..... 405/191; 405/195

[58] Field of Search ..... 61/69 R, 93, 89; 61/86, 61/87, 88, 94, 95, 98; 114/16 R, 16 E

[56] References Cited

U.S. PATENT DOCUMENTS

| | | | |
|---|---|---|---|
| 1,127,507 | 2/1915 | Piercy | 61/93 |
| 3,099,913 | 8/1963 | Melton et al. | 61/69 R |
| 3,425,230 | 2/1969 | Haynes | 61/69 R |
| 3,734,220 | 5/1973 | Smith | 61/93 X |
| 3,769,802 | 11/1973 | Wefer | 61/93 |
| 3,851,491 | 12/1974 | Mason | 61/69 R |
| 3,983,707 | 10/1976 | Lezgintsev et al. | 61/69 R |
| 4,043,134 | 8/1977 | Mason | 61/69 R |

*Primary Examiner*—Mervin Stein
*Assistant Examiner*—David H. Corbin
*Attorney, Agent, or Firm*—Lackenbach, Lilling & Siegel

[57] ABSTRACT

The device comprises a housing made in the form of a polygon having hinged sides. Installed in close proximity to housing, supports are tanks connected with fluid sources and producing positive and negative buoyancies in the region of the housing near the supports. To rotate the supports use is made of a means for varying the angles between the housing sides.

3 Claims, 6 Drawing Figures

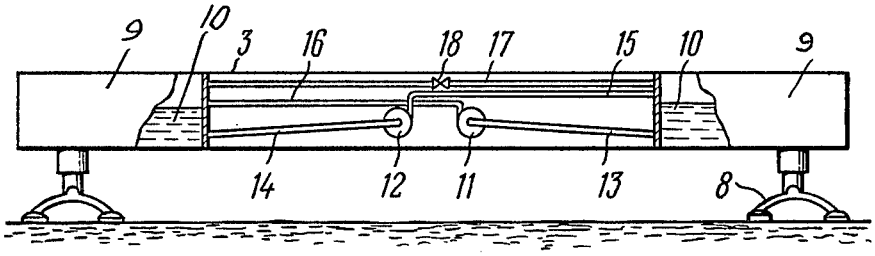
FIG. 2
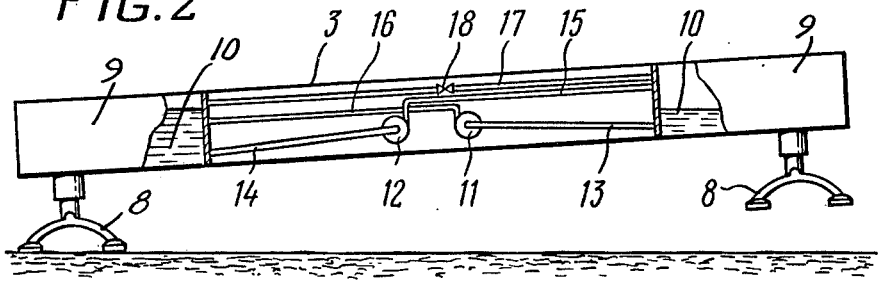
FIG. 3
FIG. 4
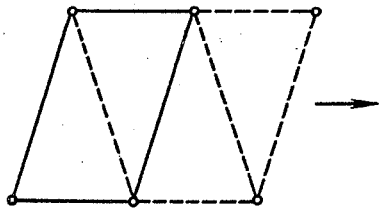
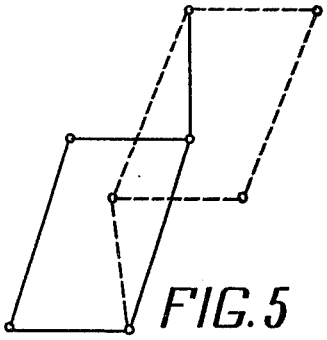
FIG. 5

DEVICE FOR TRAVELLING ALONG THE BASIN AND SEA BOTTOM

FIELD OF THE INVENTION

The present invention relates to step-driving vehicles and more particularly to devices for travelling along a basin or a sea bottom and carrying mining, prospecting and transport means when exploiting the sea bottom of useful minerals.

The present invention may be used most effectively when exploiting the sea and ocean of useful minerals.

The device according to the present invention can be also used to transfer heavy structures, to perform assembling operations and to serve as a submerged drilling base.

DESCRIPTION OF THE PRIOR ART

Known in the prior art are a method and a vehicle for travelling along a basin and sea bottom by using a stepwise movement (cf, USSR Patent Application No. 5,556/19 filed by the present Applicants in the U.S. Patent Office with the priority date fixed on Mar. 5, 1975).

The vehicle known in the prior art is made in the form of a housing with two supports. The housing is provided with two tanks mounted in a region near the supports and connected via inlet and outlet pipes with fluid sources to produce positive and negative buoyancies in the region near the supports. The vehicle is provided with a means for rotating it relative to the support having a negative buoyancy.

The housing of the known vehicle is provided with guides along which a carriage is moved, the carriage carrying working members (such as mining means, a ground pump for pumping minerals in the form of a hydraulic mixture to the enriching plants, a ground intake member for loosening and supplying the minerals, and so on).

The principle of movement of this vehicle is that after the vehicle having the negative buoyancy has been set in a operating position on the bottom, for movement in a preset direction in the region near one support the positive buoyancy is produced by supplying into the tank in region near this support the fluid whose density is less than that of a ambient medium. Due to the positive buoyancy the support is lifted above the bottom surface, but another support with a negative buoyancy is fixed on the bottom. The lifted support together with the housing is rotated in the preset direction relative to the fixed support. After the rotation has been completed the first support acquires a negative buoyancy, so that both supports are again set up on the bottom surface. The second support acquires a positive buoyancy when the first support is fixed and the cycle is repeated with the second support in a way similar to that which was done with the first support. By lifting and lowering the two supports and by rotating the vehicle relative to the support fixed on the bottom, different paths for the vehicle's movement on the bottom may be obtained.

The described vehicle has great mobility and can be used for transporting along the bottom different working members which do not require great stability for performing various submerged operations (ground sampling, TV-photo observation and so on).

SUMMARY OF THE INVENTION

It is an object of a present invention to provide high stability of the vehicle operated on the bottom.

It is another object of the present invention to provide for the high mobility and accuracy of the movement along a preset path for efficient exploitation of the submerged useful minerals.

It is still another object of the present invention to ensure processing the large areas of bottom surface.

In addition, it is an object of the present invention to provide a device simple in structure and reliable for travelling along a basin or a sea bottom.

These and other objects of the present invention are accomplished by providing a device for travelling along a basin or a sea bottom, comprising a housing with supports retaining the device above the bottom surface. Tanks are mounted in said housing and are connected through inlet and outlet pipes with filling fluid sources to produce a positive or a negative buoyancy of a housing part in close proximity to one of these supports. In addition, there is provided a means for rotating the housing relative to the supports. The housing, according to the present invention, is made in the form of a polygon with hinged sides and the tanks are installed on at least two sides of the housing. The supports are located near the place where the housing sides are articulated. The means for rotating the housing is made in such a way that the angles between said housing sides are varied.

The device according to the present invention possesses high stability during movement and maintains a static position when operating on the sea bottom. The high mobility of the device according to the present invention is achieved by the variation of the angles between the housing sides when the device is moved. At a fixed position on the bottom this device permits exploitation of a large area of the bottom when performing mining, prospecting and other operations. This is especially important when a remote or self-contained control of the device is used to operate it by a preset program.

In one of the embodiments of the device according to the present invention the housing is made in the form of a hinged parallelogram and the tanks are mounted on at least two parallel sides thereof.

This structure of the device is the most simple and provides for the necessary mobility and stability in the fixed position on the bottom as well as in during travel.

It is preferable that two parallel sides of the housing should be provided with carriages connected to each other by a crossbar for accommodating a working member. The carriages should be mounted on the parallelogram sides so as to allow reciprocation along these sides. This structure according to the present invention permits exploitation by said working member of a large area of the bottom at any fixed position of the device on the bottom.

According to one of the embodiments of the present invention the means for rotating the housing is made in the form of power hydraulic cylinders hinged to adjacent sides in the region of their articulation.

The use of the power hydraulic cylinders ensures high accuracy in the variation of the angles between the housing sides and, therefore, the high accuracy of device travelling along a preset path.

It is also expedient that the height of the supports should be adjustable. The structure of the supports according to the present invention permits operation of the device on an irregular surface of the bottom.

The embodiment with telescopic supports permits in a most simple manner compensation for the difference of heights on the bottom surface whereon the device is moved.

The specific features and advantages of the present invention will appear more completely from the following detailed description of preferred specific embodiments thereof with reference to the accompanying drawings wherein:

BRIEF DESCRIPTION OF THE DRAWINGS

FIGS. 2 and 3 are longitudinal views, partly broken away, showing one of the housing sides with tanks and a system for pumping the filling fluid when producing at both supports a negative buoyancy (FIG. 2) and when producing at one of the supports a positive buoyancy and at the other support a negative buoyancy (FIG. 3), according to the invention;

FIGS. 4 and 5 show different paths of the device on the bottom according to the invention; and;

DETAILED DESCRIPTION OF THE INVENTION

Figures 1, 6:
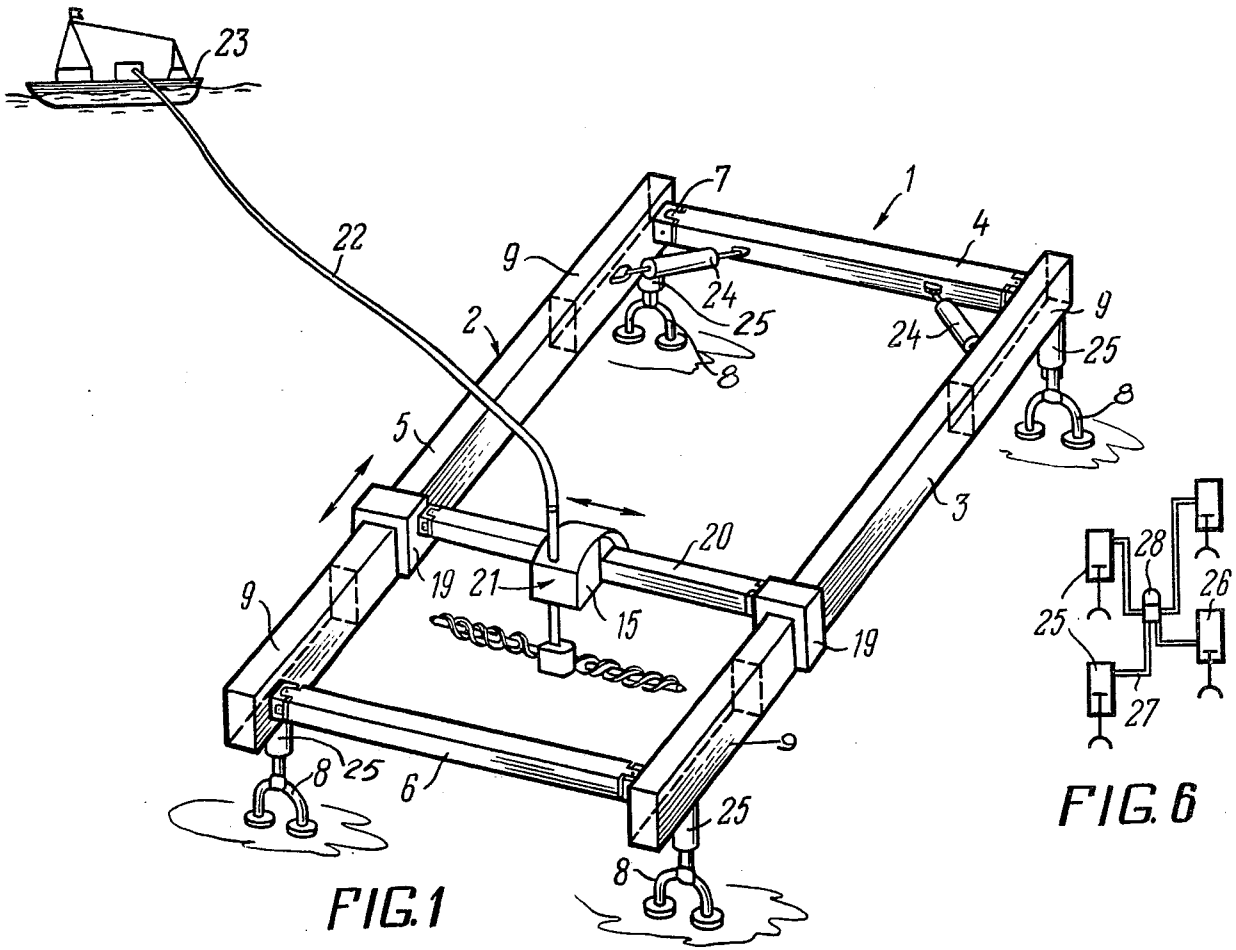
FIG. 1 is a perspective view of the device according to the invention.
FIG. 6 shows one of the embodiments of the structure of the supports according to the invention.

According to the invention, the device 1 (FIG. 1) comprises a housing 2 having the shape of a polygon, preferably of a parallelogram with sides 3, 4, 5 and 6 connected to each other with hinges 7. The housing 2 rests on supports 8 installed in the region of articulation of the sides 3, 4, 5 and 6.

To produce a positive and a negative buoyancy in the regions of the supports 8, the parallel sides 3 and 5 are provided with tanks 9, two tanks being arranged on each of the side 3 and 5. However, it is possible in an alternate embodiment of the device 1 to have each of the sides 3, 4, 5, and 6 of the housing 2 provided with one tank 9. The tanks 9 are filled with a filling fluid, for example water 10 (FIGS. 2 and 3).

Installed between the tanks 9 in each of the sides 3 and 5 of the housing 2 are two pumps 11 and 12, such as centrifugal pumps or a reversing pump. Inlet pipes 13 and 14 and outlet pipes 15 and 16 connecting the pumps 11 and 12 to both tanks 9. In addition, each pair of tanks 9 is connected to each other via a main pipe 17 provided with a bypass valve 18.

Installed on the parallel sides 3 and 5 of the housing 2 are carriages 19 (FIG. 1) reciprocating along these sides 3 and 5 (in the directions of the two headed arrow). A crossbar 20 is used to couple the carriages 19 to each other. A working member 21 of the device is installed on the crossbar 20 in such a manner as to provide for movement along said crossbar. The working member 21 made of may be made of a ground pump with a drive for pumping the minerals in the form of a hydraulic mixture to enriching plants as well as ground intake means for loosening and sucking the minerals. The working member 21 is connected via a hose cable 22 to a support vessel 23.

To vary the angles between the sides 3, 4, 5 and 6 of the housing 2 use is made of power hydraulic cylinders 24 hinged to adjacent sides 3, 4, 5 and 6 in the region of their articulation.

To operate the device 1 on the irregular surface of an bottom the supports 8 are telescopic to in order to adjust their height. The supports 8 include power hydraulic cylinders 25 (FIG. 6) whose head spaces 26 via pipes 27 are connected with a hydraulic pneumatic accumulator 28 to form a closed system filled with oil.

The device operates in the following manner.

The device can be transported to the area of operation aboard the support vessel 23 or afloat. For this purpose the crossbar 20 and the working member 21 are fixed on the housing 2 in a position calculated to provide stability and trim of the device 1. The level of water 10 in the tanks 9 is adjusted so that the required positive buoyancy is ensured. After the device 1 has been delivered to the area of operation, a portion of the air is expelled from the tanks 9 by forcing into said tanks 9 sea water 10. After the negative buoyancy has been achieved and the device 1 has been trimmed by methods known in the prior art, the device 1 is smoothly lowered to the bottom. After the device 1 has been set up in the starting position on the bottom, the whole area bounded by the 3, 4, 5 and 6 of the housing 2 is exploited by moving the carriages 19 with the crossbar 20 along the sides 3 and 5 of the housing 2 and the working member 21 along the crossbar 20. (The carriages are mounted on the sides of the housing in such a manner that they can reciprocate along the respective sides.) The required electric power and remote control signals for the mechanisms are supplied by electric power cables housed in the hose cable 22, the hose cable 22 also having inner spaces used for feeding the captured minerals to the receiving and enriching plants (not shown) of the support vessel 23, or to the shore when the device 1 operates near the seashore.

To move the device 1 to another area of, a bottom the positive buoyancy is produced for two adjacent supports 8. On each of the sides 3, 5 the valve 18 is opened simultaneously with the pump 11 being operated to pump water 10 via the pipes 13 and 16 from the right-hand tank 9 to the left-hand tank 9 (FIGS. 2 and 3). The air forced out of the left-hand tank 9 is directed by the main pipe 18 to the right-hand tank 9. Water 10 is pumped from the right-hand tanks 9 of the sides 3 and 5 until the supports 8 in the region of these tanks 9 are lifted at to a predetermined value above the bottom surface (FIG. 3).

For pumping water 10 from one tank 9 to another use can be made of a selfcontained compressed gas source installed aboard the vessel 23 as well as of compressed gas bottles (not shown) secured directly on the housing 2 of the device 1. The tanks 9 can be opened downwards. In this event the positive buoyancy in the region of the tank 9 is produced by expelling water 10 from the top part of the tank 9 with compressed gas.

The supports 8 lifted above the bottom surface are replaced by the power hydraulic cylinders 24 varying the angles between the adjacent sides 3, 4, 5 and 6. of the housing 2. After the lifted supports 8 have been rotated to a preset angle, a negative buoyancy is produced in the region of these supports 8. For this purpose the pumps 12 are operated to supply water via the pipes 14, and 15 to the tanks 9 located in the region of the lifted supports 8. Water 10 is supplied to these tanks 9 until all the supports 8 are again positioned on the bottom.

Different paths of the device 1 on the bottom (FIGS. 4 and 5) may be obtained by producing a positive and a negative buoyancy at different pairs of the suppports 8 and rotating the supports 8 lifted above the bottom surface.

The embodiment of the housing 2 in the form of a parallelogram with hinged sides 3, 4, 5 and 6 permits variance of the angles between the sides when the device travels along the bottom without disturbing its stability.

As specified above, the inclination of the bottom and some bottom irregularities are compensated for by using telescopic supports 8 to adjust their height, the supports including power hydraulic cylinders 25 (FIG. 6) whose head spaces 26 are connected to each other via pipes 27 through the hydraulic/pneumatic accumulator 28.

When the positive buoyancy is provided in region of any pair of the supports 8, the load is increased on the other pair of the supports 8 and the pressure in the head spaces 26 of the power hydraulic cylinders 25 of these supports 8 increases. Due to the increased pressure in these supports 8 the oil is supplied into the power hydraulic cylinders 25 of the supports 8 lifted above the bottom surface. The oil flows into the power hydraulic cylinders 25 until the rods of these cylinders 25 advance home. After the rotation has been accomplished and the supports 8 lifted above the bottom have been positioned to a new area of the bottom, the negative buoyancy is produced in region of these supports 8 and said supports 8 are lowered until they contact the bottom ground. After the supports 8 have contacted the bottom, the rods of the cylinders 25 of the supports lifted before are removed home and the whole structure is positioned gradually on the bottom ground until all the supports 8 are set up on the ground and the pressure in the head spaces 26 of the cylinders of all the supports is equalized. The hydraulic/pneumatic accumulator 28 smoothes the pressure pulsation in the system. The selfadjustment of the height of the supports 8 and of the pressure in their power hydraulic cylinders 25 precludes deformation of the housing 2 of the device 1.

To control all the mechanisms of the device 1 use is made of a control unit (not shown) which can be installed aboard the support vessel 23 as well as directly on the housing 2 of the device 1.

What is claimed is:

1. A device for travelling along the bottom surface of a basin, comprising: a housing made in the form of a polygon with sides connected to each other by hinges; supports connected to said housing, retaining said housing above the bottom surface and positioned near the hinges where the sides of said housing are articulated; tanks mounted on at least two sides of said housing near the supports; filling fluid sources with inlet and outlet pipes associated with said tanks to produce a positive or a negative buoyancy of the portion of the housing in which the respective tank is included; power hydraulic cylinders, for rotating said housing relative to said supports, connected to adjacent sides of the housing in a region near the hinges, so as to vary the angle between said adjacent sides; and, carriages mounted on parallel sides of the housing, said carriages being connected to each other with a crossbar which accommodates a working member, the carriages being mounted on the sides of the housing in such a manner that they can reciprocate along the respective sides.

2. A device as claimed in claim 1, wherein the housing is made in the form of a hinged parallelogram and the tanks are installed on at least two parallel sides.

3. A device as claimed in claim 1, wherein the supports telescope.

* * * * *